US009341376B2

(12) United States Patent
Westmoreland, III et al.

(10) Patent No.: US 9,341,376 B2
(45) Date of Patent: May 17, 2016

(54) COMBUSTOR AND METHOD FOR SUPPLYING FUEL TO A COMBUSTOR

(75) Inventors: James Harold Westmoreland, III, Greer, SC (US); Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1124 days.

(21) Appl. No.: 13/400,248

(22) Filed: Feb. 20, 2012

(65) Prior Publication Data

US 2013/0213051 A1 Aug. 22, 2013

(51) Int. Cl.
*F23R 3/28* (2006.01)
*F23D 14/62* (2006.01)
*F23R 3/36* (2006.01)

(52) U.S. Cl.
CPC ..... *F23R 3/286* (2013.01); *F23D 14/62* (2013.01); *F23R 3/36* (2013.01)

(58) Field of Classification Search
CPC ..... F23R 3/286; F23R 3/36
USPC ..... 60/737/740/742/748
See application file for complete search history.

(56) References Cited

U.S. PATENT DOCUMENTS 2,565,843 A * 8/1951 Dennison ..... 60/747
3,055,179 A * 9/1962 Lefebvre ..... F23R 3/02 60/726
4,100,733 A * 7/1978 Striebel et al. ..... 60/39.463
4,104,873 A 8/1978 Coffinberry
4,262,482 A * 4/1981 Roffe ..... F02C 7/224 431/247
4,412,414 A 11/1983 Novick et al.
5,213,494 A 5/1993 Jeppesen
5,341,645 A 8/1994 Ansart et al.
5,592,819 A 1/1997 Ansart et al.
6,070,411 A * 6/2000 Iwai et al. ..... 60/737
6,158,223 A * 12/2000 Mandai ..... F23D 23/00 60/737
6,394,791 B2 5/2002 Smith et al.
6,438,961 B2 8/2002 Tuthill et al.
6,983,600 B1 1/2006 Dinu et al.
7,003,958 B2 2/2006 Dinu et al.
7,007,478 B2 3/2006 Dinu
7,631,499 B2 12/2009 Bland
7,752,850 B2 7/2010 Laster et al.
2008/0016876 A1 1/2008 Colibaba-Evulet et al.
2008/0304958 A1 12/2008 Norris et al.
2010/0008179 A1 1/2010 Lacy et al.
2010/0024426 A1 2/2010 Varatharajan et al.
2010/0031662 A1 2/2010 Zuo
2010/0060391 A1 3/2010 Ristola et al.
2010/0084490 A1 4/2010 Zuo et al.
2010/0089367 A1 4/2010 Johnson et al.

(Continued)

*Primary Examiner* — Phutthiwat Wongwian
*Assistant Examiner* — Stefan Ibroni
(74) *Attorney, Agent, or Firm* — Dority & Manning, PA

(57) ABSTRACT

A combustor includes an end cap having upstream and downstream surfaces and a cap shield surrounding the upstream and downstream surfaces. First and second sets of premixer tubes extend from the upstream surface through the downstream surface. A first fuel conduit supplies fuel to the first set of premixer tubes. A casing circumferentially surrounds the cap shield to define an annular passage, and a second fuel conduit supplies fuel through the annular passage to the second set of premixer tubes. A method for supplying fuel to a combustor includes flowing a working fluid through first and second sets of premixer tubes, flowing a first fuel into the first set of premixer tubes, and flowing a second fuel through an annular passage surrounding the end cap and into the second set of premixer tubes.

17 Claims, 4 Drawing Sheets

(56) References Cited

U.S. PATENT DOCUMENTS

| | | | | |
|---|---|---|---|---|
| 2010/0139280 | A1 | 6/2010 | Lacey et al. | |
| 2010/0186413 | A1* | 7/2010 | Lacy | F23R 3/10 60/740 |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |
| 2013/0084534 | A1* | 4/2013 | Melton | F23R 3/10 431/2 |

* cited by examiner

COMBUSTOR AND METHOD FOR SUPPLYING FUEL TO A COMBUSTOR

FIELD OF THE INVENTION

The present invention generally involves a combustor and method for supplying fuel to a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, localized hot streaks in the combustion chamber may increase the disassociation rate of diatomic nitrogen, increasing the production of nitrogen oxides ($NO_X$) at higher combustion gas temperatures. Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, a plurality of premixer tubes may be radially arranged in an end cap to provide fluid communication for the working fluid and fuel flowing through the end cap and into the combustion chamber. The premixer tubes enhance mixing between the working fluid and fuel to reduce hot streaks that can be problematic with higher combustion gas temperatures. As a result, the premixer tubes are effective at preventing flashback or flame holding and/or reducing $NO_X$ production, particularly at higher operating levels. However, an improved system and method for supplying fuel to the premixer tubes that allows for staged fueling or operation of the premixer tubes at varying operational levels would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor

Another embodiment of the present invention is a combustor that includes

The present invention may also include a method for supplying fuel to a combustor. The method includes Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
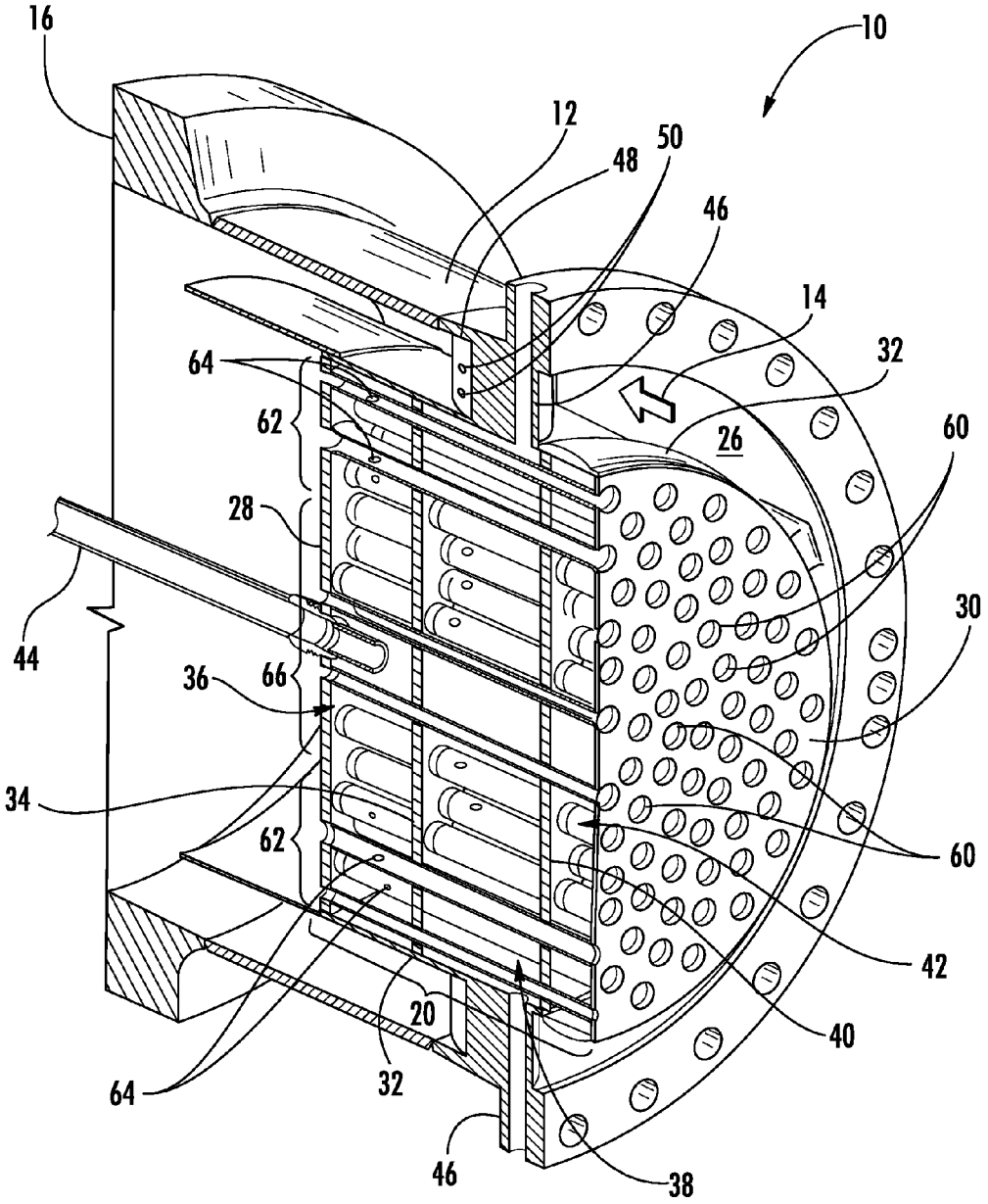
FIG. 1 is a partial perspective view of a combustor according to a first embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a combustor and method for supplying fuel to a combustor. In particular embodiments, a plurality of tubes arranged in an end cap enhance mixing between a working fluid and fuel prior to combustion. The fuel may be supplied to the tubes through one or more axial and/or radial fuel conduits. In this manner, the tubes may be grouped into multiple fuel circuits that enable the combustor to be operated over a wide range of operating conditions without exceeding design margins associated with flashback, flame holding, and/or emissions limits. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Figure 2:
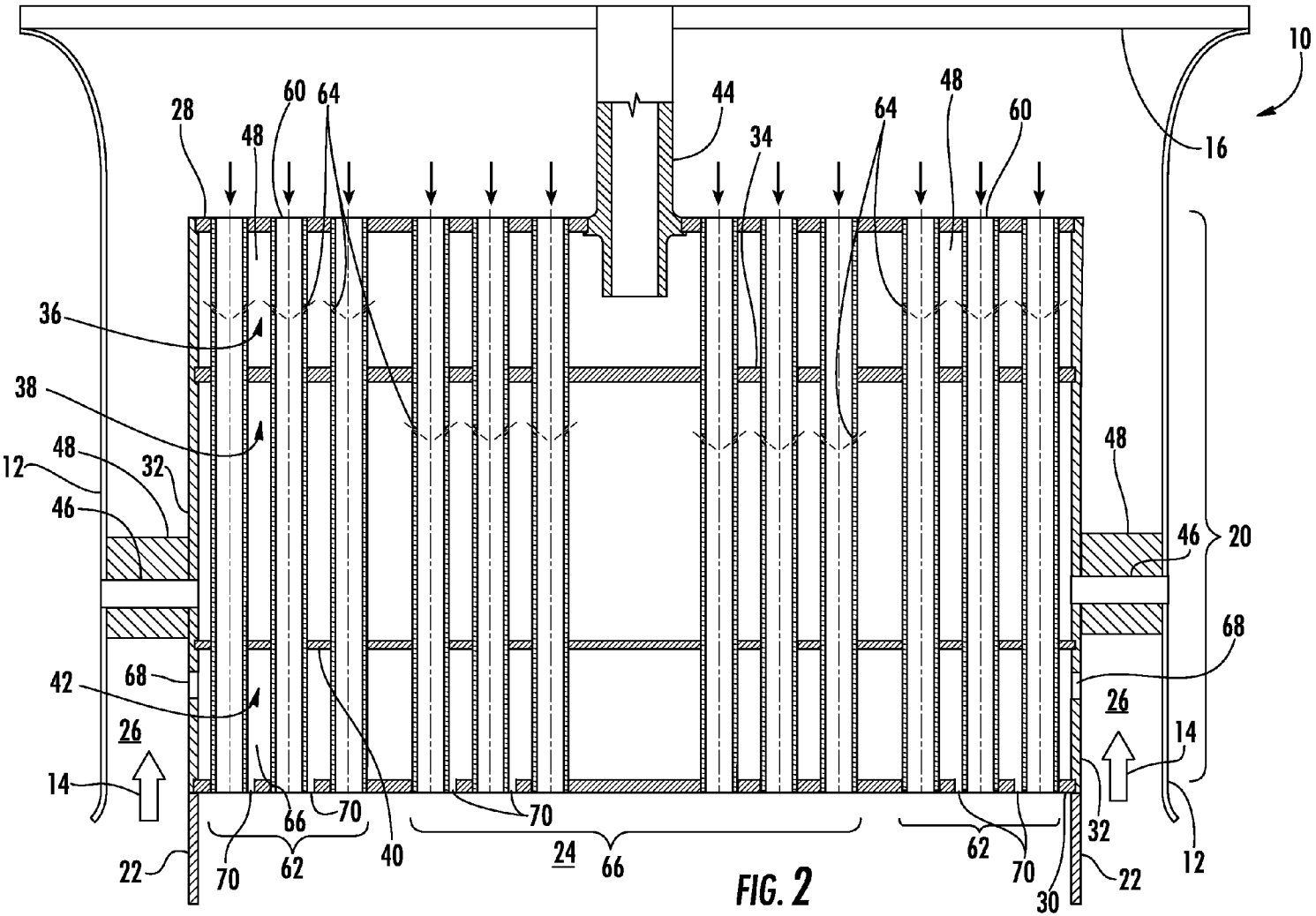
FIG. 2 is a side cross-section view of the combustor shown in FIG. 1.

FIG. 1 provides a partial perspective view of a combustor 10 according to a first embodiment of the present invention, and FIG. 2 provides a side cross-section of the combustor 10 shown in FIG. 1. As shown, a casing 12 generally surrounds the combustor 10 to contain a working fluid 14 flowing to the combustor 10. The casing 12 may include an end cover 16 at one end to provide an interface for supplying fuel, diluent, and/or other additives to the combustor 10. Possible diluents may include, for example, water, steam, working fluid, air, fuel additives, various inert gases such as nitrogen, and/or various non-flammable gases such as carbon dioxide or combustion exhaust gases supplied to the combustor 10. An end cap 20 is configured to extend radially across at least a portion of the combustor 10, and the end cap 20 and a liner 22 generally define a combustion chamber 24 downstream from the end cap 20. The casing 12 circumferentially surrounds the end cap 20 and/or the liner 22 to define an annular passage 26 that surrounds the end cap 20 and liner 22. In this manner, the working fluid 14 may flow through the annular passage 26 along the outside of the liner 22 to provide convective cooling to the liner 22. When the working fluid 14 reaches the end cover 16, the working fluid 14 may reverse direction to flow through the end cap 20 and into the combustion chamber 24.

The end cap 20 generally includes an upstream surface 28 axially separated from a downstream surface 30. A cap shield 32 may circumferentially surround at least a portion of the upstream and downstream surfaces 28, 30 to at least partially define one or more plenums inside the end cap 20 between the upstream and downstream surfaces 28, 30. For example, in the particular embodiment shown in FIGS. 1 and 2, a first barrier 34 may extend radially inside the end cap 20 and/or cap shield 32 to axially separate a first fuel plenum 36 from a second fuel plenum 38. In addition, a second barrier 40 may extend radially inside the end cap 20 and/or cap shield 32 to separate a diluent plenum 42 from the first and second fuel plenums 36, 38 inside the end cap 20 and/or cap shield 32.

A first fuel conduit 44 may extend axially from the end cover 16 to provide fluid communication through the end cover 16 to the first fuel plenum 36, and a second fuel conduit 46 may extend radially through the casing 12, annular passage 26, and cap shield 32 to provide fluid communication through the casing 12, annular passage 26, and cap shield 32 to the second fuel plenum 38. As shown in FIGS. 1 and 2, at least one of an airfoil 48 or a vane may surround at least a portion of the second fuel conduit 46 in the annular passage 26 to reduce flow resistance of the working fluid 14 flowing across the second fuel conduit 46 in the annular passage 26. In particular embodiments, the airfoil 48 or vane may be angled to impart swirl to the working fluid 14 flowing through the annular passage 26. Alternately, or in addition, the airfoil 48 or vane may include one or more quaternary fuel ports 50 that provide fluid communication from the second fuel conduit 46 through the airfoil 48 or vane and into the annular passage 26. In this manner, the first fuel conduit 44 may supply fuel to the first fuel plenum 36, and the second fuel conduit 48 may supply the same or a different fuel to the second fuel plenum 38 and/or the annular passage 26.

A plurality of tubes 60 may extend from the upstream surface 28 through the downstream surface 30 to provide fluid communication through the end cap 20. The particular shape, size, number, and arrangement of the tubes 60 may vary according to particular embodiments. For example, the tubes 60 are generally illustrated as having a cylindrical shape; however, alternate embodiments within the scope of the present invention may include tubes having virtually any geometric cross-section. A first set of the tubes 62 may include one or more fuel ports 64 that provide fluid communication from the first fuel plenum 36 into the first set of tubes 62, and a second set of the tubes 66 may include one or more fuel ports 64 that provide fluid communication from the second fuel plenum 38 into the second set of tubes 66. The fuel ports 64 may be angled radially, axially, and/or azimuthally to project and/or impart swirl to the fuel flowing through the fuel ports 64 and into the tubes 60. In this manner, the working fluid 14 may flow outside the end cap 20 through the annular passage 26 until it reaches the end cover 16 and reverses direction to flow through the first and second sets of tubes 62, 66. In addition, fuel from the first fuel conduit 44 may flow around the first set of tubes 62 in the first fuel plenum 36 to provide convective cooling to the tubes 60 before flowing through the fuel ports 64 and into the first set of tubes 62 to mix with the working fluid 14. Similarly, fuel from the second fuel conduit 46 may flow around the second set of tubes 66 to provide convective cooling to the second set of tubes 66 before flowing through the fuel ports 64 and into the second set of tubes 66 to mix with the working fluid 14. The fuel-working fluid mixture from each set of tubes 62, 66 may then flow into the combustion chamber 24.

As shown in FIGS. 1 and 2, one or more diluent ports 68 may provide fluid communication from the annular passage 26, through the cap shield 32, and into the diluent plenum 42. In this manner, at least a portion of the working fluid 14 may flow from the annular passage 26 into the diluent plenum 42 to flow around the first and/or second sets of tubes 62, 66 to provide convective cooling to the tubes 60. The working fluid 14 may then flow through gaps 70 between the downstream surface 38 and the tubes 60 before flowing into the combustion chamber 24.

Figure 3:
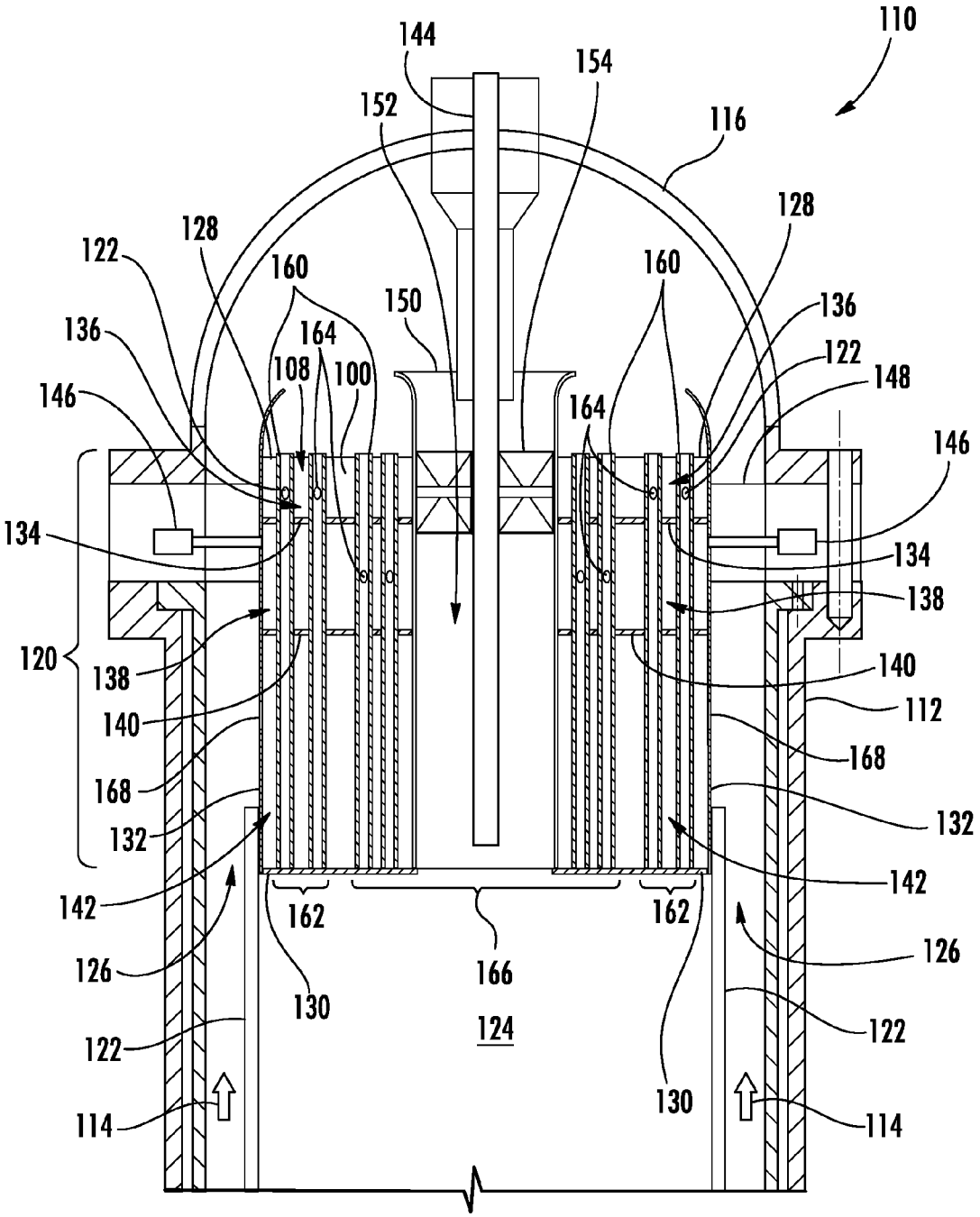
FIG. 3 is a side cross-section view of a combustor according to a second embodiment of the present invention.

FIG. 3 provides a side cross-section view of a combustor 110 according to a second embodiment of the present invention. As shown, a casing 112 again generally surrounds the combustor 110 to contain a working fluid 114 flowing to the combustor 110. The casing 112 may include an end cover 116 at one end to provide an interface for supplying fuel, diluent, and/or other additives to the combustor 110. An end cap 120 is configured to extend radially across at least a portion of the combustor 110, and the end cap 120 and a liner 122 generally define a combustion chamber 124 downstream from the end cap 120. The casing 112 circumferentially surrounds the end cap 120 and/or the liner 122 to define an annular passage 126 that surrounds the end cap 120 and liner 122. In this manner, the working fluid 114 may flow through the annular passage 126 along the outside of the liner 122 to provide convective cooling to the liner 122. When the working fluid 114 reaches the end cover 116, the working fluid 114 may reverse direction to flow through the end cap 120 and into the combustion chamber 124.

The end cap 120 generally includes an upstream surface 128 axially separated from a downstream surface 130. A cap shield 132 may circumferentially surround at least a portion of the upstream and downstream surfaces 128, 130 to at least partially define one or more plenums inside the end cap 120 between the upstream and downstream surfaces 128, 130. For example, in the particular embodiment shown in FIG. 3, a first barrier 134 may extend radially inside the end cap 120 and/or cap shield 132 to axially separate a first fuel plenum 136 from a second fuel plenum 138. In addition, a second barrier 140 may extend radially inside the end cap 120 and/or cap shield 132 to separate a diluent plenum 142 from the first and second fuel plenums 136, 138 inside the end cap 120 and/or cap shield 132.

A first fuel conduit 144 may extend axially from the end cover 116 to provide fluid communication through the end cover 116 to the first fuel plenum 136, and a second fuel conduit 146 may extend radially through the casing 112, annular passage 126, and cap shield 132 to provide fluid communication through the casing 112, annular passage 126, and cap shield 132 to the second fuel plenum 138. As shown in FIG. 3, at least one of an airfoil 148 or a vane may surround at least a portion of the second fuel conduit 146 in the annular passage 126 to reduce flow resistance of the working fluid 114 flowing across the second fuel conduit 146 in the annular passage 126. In particular embodiments, the airfoil 148 or vane may be angled to impart swirl to the working fluid 114 flowing through the annular passage 126.

In the particular embodiment shown in FIG. 3, a shroud 150 circumferentially surrounds the first fuel conduit 144 to define an annular fluid passage 152 between the shroud 150 and the first fuel conduit 144. One or more swirler vanes 154 may be located between the shroud 150 and the first fuel conduit 144 to impart swirl to the working fluid 114 flowing through the annular fluid passage 152. In addition, the first fuel conduit 144 may extend radially inside the swirler vanes 154 and across the annular fluid passage 152. In this manner, the first fuel conduit 144 may provide fluid communication through the swirler vanes 154 to the first fuel plenum 136 and/or the annular fluid passage 152.

As in the previous embodiment, a plurality of tubes 160 may extend from the upstream surface 128 through the downstream surface 130 to provide fluid communication through the end cap 120. The particular shape, size, number, and arrangement of the tubes 160 may vary according to particular embodiments. For example, the tubes 160 are generally illustrated as having a cylindrical shape; however, alternate embodiments within the scope of the present invention may include tubes having virtually any geometric cross-section. A first set of the tubes 162 may include one or more fuel ports 164 that provide fluid communication from the first fuel plenum 136 into the first set of tubes 162, and a second set of the tubes 166 may include one or more fuel ports 164 that provide fluid communication from the second fuel plenum 138 into the second set of tubes 166. The fuel ports 164 may be angled radially, axially, and/or azimuthally to project and/or impart swirl to the fuel flowing through the fuel ports 164 and into the tubes 160. In this manner, the working fluid 114 may flow outside the end cap 120 through the annular passage 126 until it reaches the end cover 116 and reverses direction to flow through the first and second sets of tubes 162, 166. In addition, fuel from the first fuel conduit 144 may flow around the first set of tubes 162 in the first fuel plenum 136 to provide convective cooling to the tubes 160 before flowing through the fuel ports 164 and into the first set of tubes 162 to mix with the working fluid 114. Similarly, fuel from the second fuel conduit 146 may flow around the second set of tubes 166 to provide convective cooling to the second set of tubes 166 before flowing through the fuel ports 164 and into the second set of tubes 166 to mix with the working fluid 114. The fuel-working fluid mixture from each set of tubes 162, 166 may then flow into the combustion chamber 124.

As shown in FIG. 3, one or more diluent ports 168 may provide fluid communication from the annular passage 126, through the cap shield 132, and into the diluent plenum 142. In this manner, at least a portion of the working fluid 114 may flow from the annular passage 126 into the diluent plenum 142 to flow around the first and/or second sets of tubes 162, 166 to provide convective cooling to the tubes 160. The working fluid 114 may then flow through gaps (not visible) between the downstream surface 130 and the tubes 160 before flowing into the combustion chamber 124.

Figure 4:
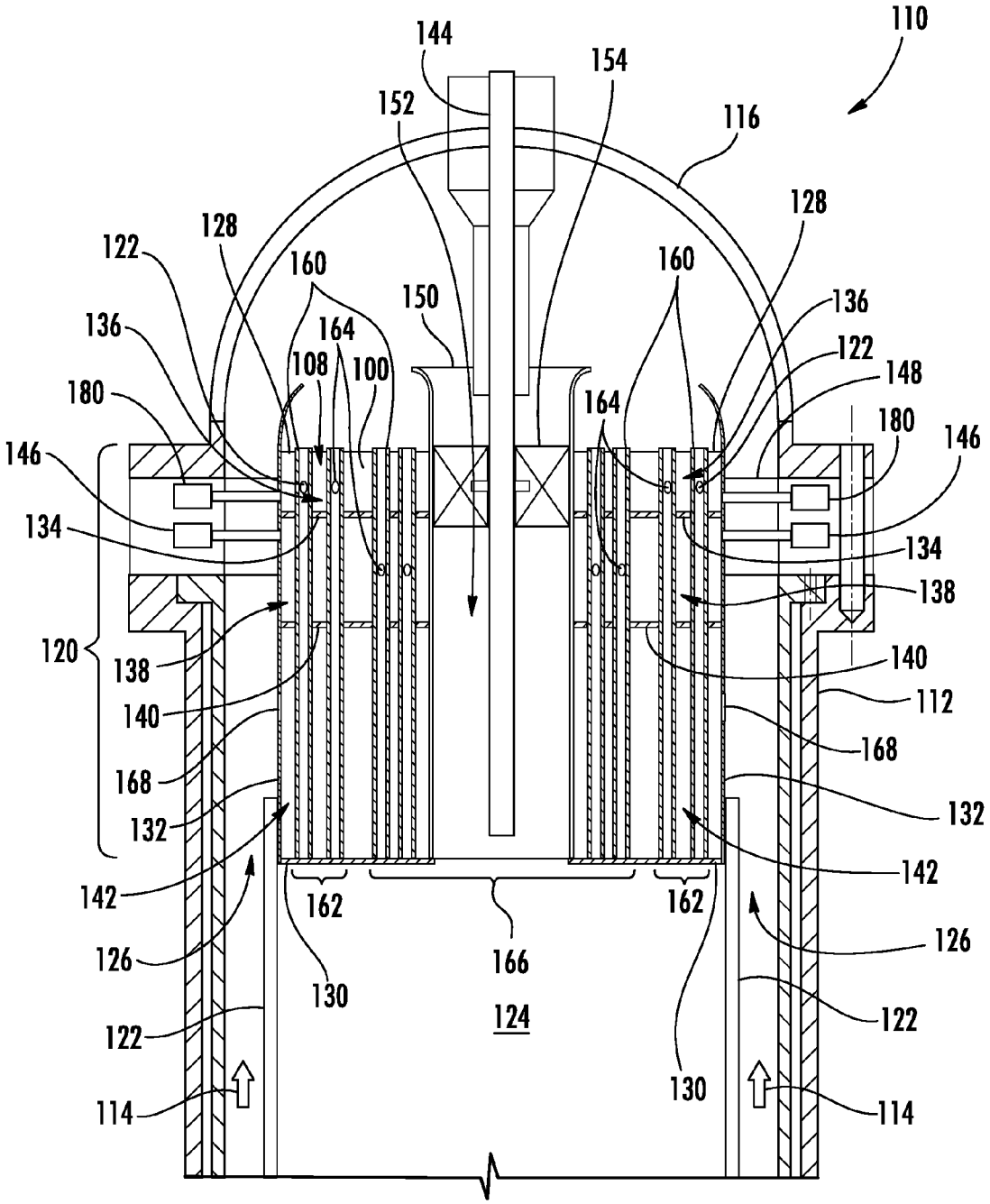
FIG. 4 is a side cross-section view of a combustor according to a third embodiment of the present invention.

FIG. 4 provides an enlarged cross-section view of the combustor 110 shown in FIG. 3 according to a third embodiment of the present invention. As shown, the combustor 110 generally includes the same components as previously described with respect to the embodiment shown in FIG. 3. In this particular embodiment, the first fuel conduit 144 may again extend radially inside the swirler vanes 154 to provide fluid communication to the annular fluid passage 152; however, the first fuel conduit 144 does not necessarily extend to the first fuel plenum 136. Instead, a third fuel conduit 180 may extend radially through the casing 112, annular passage 126, and cap shield 132 to provide fluid communication through the casing 112, annular passage 126, and cap shield 132 to the first fuel plenum 136. In this manner, the first fuel conduit 144 may supply fuel to the annular fluid passage 152, the second fuel conduit 146 may supply the same or a different fuel to the second fuel plenum 138, and the third fuel conduit 180 may supply yet another or the same fuel to the first fuel plenum 136.

The various embodiments shown in FIGS. 1-4 provide multiple combinations of methods for supplying fuel to the combustor 10, 110. For example, referring to the embodiment shown in FIG. 4, the working fluid 114 may be supplied through the first and second sets of tubes 162, 166 and/or the annular fluid passage 152. A first fuel may be supplied through the first fuel conduit 144 to the annular fluid passage 152. Alternately, or in addition, a second fuel may be supplied through the second fuel conduit 46 to the second set of tubes 66 and/or directly into the working fluid 14 flowing through the annular passage 26, as described with respect to the embodiment shown in FIGS. 1 and 2. Still further, a third fuel may be supplied through the third fuel conduit 180 to the first set of tubes 162. Each embodiment thus provides very flexible methods for providing staged fueling to various locations across the combustor 10, 110 to enable the combustor 10, 110 to operate over a wide range of operating conditions without exceeding design margins associated with flashback, flame holding, and/or emissions limits.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor, comprising:

an outer casing, a portion of the outer casing at least partially defining a fuel conduit therein;

an end cap assembly that extends radially and axially within the outer casing, the end cap assembly having an annular cap shield that extends axially between an upstream surface and a downstream surface, a first fuel plenum defined within the cap shield between the upstream surface and a first barrier plate and a second fuel plenum defined within the cap shield between the first barrier plate and a second barrier plate, a plurality of tubes that provide for fluid communication through the upstream surface, the first fuel plenum, the first barrier plate, the second fuel plenum, the second barrier plate and the downstream surface, wherein an outer surface of the cap shield is radially spaced from an inner surface of the casing to define an annular passage therebetween;

a plurality of airfoils that extend radially through the annular passage from the inner surface of the outer casing to the outer surface of the cap shield, wherein at least one airfoil of the plurality of airfoils provides for fluid communication between the fuel conduit and at least one of the first fuel plenum or the second fuel plenum; and an axially extending fuel conduit that extends through the upstream surface into the first fuel plenum.

2. The combustor as in claim 1, wherein the plurality of tubes comprises a first set of tubes and a second set of tubes, at least one tube of the first set of tubes includes a fuel port positioned within and in fluid communication with the first fuel plenum.

3. The combustor as in claim 1, wherein the plurality of tubes comprises a first set of tubes and a second set of tubes, at least one tube of the second set of tubes includes a fuel port positioned within and in fluid communication with the second fuel plenum.

4. The combustor as in claim 1, wherein the at least one airfoil of the plurality of airfoils provides for fluid communication between the fuel conduit and the first fuel plenum.

5. The combustor as in claim 1, wherein the at least one airfoil of the plurality of airfoils provides for fluid communication between the fuel conduit and the second fuel plenum.

6. The combustor as in claim 1, wherein the at least one airfoil of the plurality of airfoils provides for fluid communication between the fuel conduit and the first fuel plenum and the second fuel plenum.

7. The combustor as in claim 1, wherein the at least one airfoil of the plurality of airfoils provides for fluid communication between the fuel conduit and the second fuel plenum and the axially extending fuel conduit provides for fluid communication between a fuel supply and the first fuel plenum.

8. The combustor as in claim 1, wherein at least one airfoil of the plurality of airfoils includes at least one quaternary fuel port in fluid communication with the fuel conduit, wherein the quaternary fuel port provides for fluid communication between the fuel conduit and the annular passage.

9. The combustor as in claim 1, wherein the end cap assembly further comprises a diluent plenum defined between the second barrier plate and the downstream surface, wherein the diluent plenum is in fluid communication with the annular passage.

10. A combustor, comprising:

an outer casing, a portion of the outer casing at least partially defining a fuel conduit therein;

an end cap assembly that extends radially and axially within the outer casing, the end cap assembly having an annular cap shield that extends axially between an upstream surface and a downstream surface, a fuel plenum defined within the cap shield between the upstream surface and the downstream surface, a plurality of tubes that provide for fluid communication through the upstream surface, the fuel plenum and the downstream surface, wherein an outer surface of the cap shield is radially spaced from an inner surface of the casing to define an annular passage therebetween;

a plurality of airfoils that extend radially through the annular passage from the inner surface of the outer casing to the outer surface of the cap shield, wherein at least one airfoil of the plurality of airfoils provides for fluid communication between the fuel conduit and the fuel plenum; and an axially extending fuel conduit that extends through the upstream surface into the fuel plenum.

11. The combustor as in claim 10, wherein the fuel conduit extends circumferentially within the outer casing.

12. The combustor as in claim 10, wherein the plurality of tubes comprises a first set of tubes and a second set of tubes, at least one tube of the first set of tubes includes a fuel port positioned within and in fluid communication with the fuel plenum.

13. The combustor as in claim 10, wherein the plurality of tubes comprises a first set of tubes and a second set of tubes, at least one tube of the second set of tubes includes a fuel port positioned within and in fluid communication with the fuel plenum.

14. The combustor as in claim 10, wherein the fuel plenum is defined between the upstream surface and a barrier plate that extends radially and circumferentially within the cap shield.

15. The combustor as in claim 10, wherein the fuel plenum is defined within the cap shield between a first barrier plate that extends radially and circumferentially within the cap shield and a second barrier plate that extends radially and circumferentially within the cap shield.

16. The combustor as in claim 10, wherein at least one airfoil of the plurality of airfoils includes at least one quaternary fuel port in fluid communication with the fuel conduit, wherein the quaternary fuel port provides for fluid communication between the fuel conduit and the annular passage.

17. The combustor as in claim 10, wherein the end cap assembly further comprises a diluent plenum defined between a barrier plate and the downstream surface, wherein the diluent plenum is in fluid communication with the annular passage.

* * * * *